US007614717B2

(12) United States Patent
Deng

(10) Patent No.: US 7,614,717 B2
(45) Date of Patent: Nov. 10, 2009

(54) PEN FAULT CHECK CIRCUIT FOR INK JET PRINTER

(75) Inventor: Chunxing Deng, ShenZhen (CN)

(73) Assignee: Shenshen STS Microelectronics Co., Ltd. (CN)

( * ) Notice: Subject to any disclaimer, the term of this patent is extended or adjusted under 35 U.S.C. 154(b) by 326 days.

(21) Appl. No.: 11/103,695

(22) Filed: Apr. 12, 2005

(65) Prior Publication Data

US 2005/0231538 A1 Oct. 20, 2005

(30) Foreign Application Priority Data

Apr. 16, 2004 (CN) ..... 2004 1 0035042

(51) Int. Cl.
*B41J 29/393* (2006.01)

(52) U.S. Cl. ..... 347/19; 347/5; 347/9

(58) Field of Classification Search ..... 347/19, 347/9, 14, 211, 5, 12; 400/120.01; 324/549
See application file for complete search history.

(56) References Cited

U.S. PATENT DOCUMENTS

| | | | | |
|---|---|---|---|---|
| 4,161,670 | A | 7/1979 | Kern | |
| 4,171,527 | A | 10/1979 | Osborne et al. | |
| 4,282,535 | A | 8/1981 | Kern et al. | |
| 4,350,989 | A | 9/1982 | Sagae et al. | |
| 4,439,776 | A | 3/1984 | Zeiler | |
| 4,716,418 | A | 12/1987 | Heinzl et al. | |
| 4,994,821 | A | 2/1991 | Fagerquist | |
| 5,130,726 | A | 7/1992 | Fukushima et al. | |
| 5,642,148 | A * | 6/1997 | Fukushima et al. | 347/211 |
| 5,764,247 | A | 6/1998 | Asai | |
| 5,951,175 | A * | 9/1999 | Kawamori | 400/120.01 |
| 6,039,428 | A | 3/2000 | Juve | |
| 6,191,989 | B1 * | 2/2001 | Luk et al. | 365/207 |
| 6,193,343 | B1 | 2/2001 | Norigoe et al. | |
| 6,547,353 | B2 | 4/2003 | Hopkins | |
| 6,731,159 | B2 * | 5/2004 | Van Zanten et al. | 327/543 |
| 6,799,837 | B1 * | 10/2004 | Chen et al. | 347/56 |
| 2003/0156149 | A1 * | 8/2003 | Choi | 347/19 |

OTHER PUBLICATIONS

Office Action for CN Application No. 200410035042.5, mailed Apr. 25, 2008, pp. 3.

* cited by examiner

*Primary Examiner*—Lam S Nguyen
(74) *Attorney, Agent, or Firm*—Lisa K. Jorgenson; William J. Kubida

(57) ABSTRACT

A pen fault check circuit for an ink jet printer that includes a comparator that further includes a pen signal input, and a switch array coupled to the pen signal input, where the switch array includes a high voltage diode. Also, a method of checking for faults in a pen of an ink jet printer that includes the steps of generating a pen signal from a first constant current source and a pulse line resistance from a pulse line of an ink jet nozzle, generating a reference signal from a second constant current source and an external resistance from a external resistor, where the first current source and the second current source generate equal currents, and comparing the pen signal and the reference signal to determine if the ink jet nozzle is in a fault state.

25 Claims, 8 Drawing Sheets

PEN FAULT CHECK CIRCUIT FOR INK JET PRINTER

RELATED APPLICATIONS

This application claims the priority benefit of Chinese application Serial No. 200410035042.5 filed on Apr. 16, 2004, the full disclosure of which is incorporated herein by reference.

BACKGROUND OF THE INVENTION

1. Field of the Invention

This invention relates to a circuit that is used to detect pen faults in an ink jet printer. Specifically, the invention relates to a circuit that checks for open circuit and short circuit faults in the print driver circuitry.

2. Relevant Background

Ink jet printers are cost effective tools for producing high-quality color and black-and-white pictures and text. Conventional print mechanisms in ink jet printers include one or more ink-filled print cartridges coupled to a printer head. The printer head has a "pen" that includes one or more electrically controllable ink flow channels that couple to an ink reservoir and operate to emit the ink through a nozzle onto a print substrate (e.g., a piece of paper).

Thermal ink jet printers use heat to fire ink onto the paper. The ink is heated by a heating element associated with each nozzle. A power driver circuit supplies a pulse of current to each heating element at a predetermined time causing ink proximate to the heating element to vaporize and create a bubble until the pressure forces the bubble to burst and emit an ink drop in the order of 5-10 picoliter. The bubble then collapses as the heating element cools, and the resulting vacuum draws ink from a reservoir to replace the ink that was emitted.

Printing resolution is largely determined by the frequency with which the print head nozzle can be cycled through these steps. To heat the element rapidly, a significant amount of energy is delivered to the heating element in a short amount of time. For example, a power supply in the 10-24 volt range may be used to deliver the power pulse. Because this power supply voltage is higher than conventional logic power levels (e.g., 2.7-5.0 volts), the switches used to deliver power to the heater elements are high voltage devices.

Performance of the print head is significantly affected by the ability to consistently and reliably apply precisely determined quantity of power to the heating element. Unfortunately, contaminants in the ink and elsewhere can create short circuits (i.e., excessive leakage current) and open circuits (i.e., excessive parasitic resistance) in the printer head that cause the nozzles to misfire or not fire at all. Excessive leakage and parasitic resistance causes power to be diverted from the heater element and therefore affect printing performance. In addition, faults can occur in the connection between the print cartridge and the cartridge driver circuitry that result in short and open circuits.

In light of these problems, many ink jet printers include fault check circuits that check the printing mechanism for short and open circuits that degrade the quality of printed images and text. These fault check circuits are implemented as integrated circuit devices that couple to the drive circuits of the pen. The fault check circuitry detects when an open or short circuit exists in the circuitry that drives an ink jet nozzle so that the faulty nozzle may be shut down, repaired, or replaced, among other corrective actions.

The fault check circuitry essentially applies a voltage or current signal to the nozzle units to measure the equivalent resistance ($R_{eq}$) of the nozzle unit. The equivalent resistance is compared to a threshold resistance ($R_{th}$) where $R_{th}$ is established at a value that would indicate excessive leakage or parasitic resistance. In practice this fault check is performed by applying a test signal to the pen circuitry and measuring a responsive signal. Comparator logic is used to compare the response signal to a reference signal where the reference signal is based on (i.e., proportional to) the value of $R_{th}$. Hence, for the comparator logic to operate properly, the value of $R_{th}$ must have a known relationship to the equivalent resistance $R_{eq}$ of the pen.

Unfortunately, conventional fault check circuitry includes high voltage switches that are coupled to the pen circuitry so that the fault check circuitry is not damaged by the high voltages applied during normal operation. Consequently, the fault check mechanism has a relatively large die size associated with high voltage devices. Thus, there remains a need for pen fault check circuitry that has a reduced die size.

Another problem with conventional fault check circuitry is that false readings, both positive and negative, can be generated because $R_{th}$ is determined by components integrated with the fault check circuitry and is not readily adjusted to match the pen circuitry. As a result, the $R_{th}$ value is affected by a number of variables such as manufacturing variances, changes in environmental conditions, and operating conditions such as supply voltage variations. In conventional circuits the value of $R_{th}$ is sensitive to changes in the power supply voltage, internal gain of the pen fault circuit logic devices, resistance variation of resistors within the pen fault circuit logic devices, operating temperature, and other variables. It would be desirable to compensate the comparator logic for these variations.

Still another problem with fault check circuitry is that it can be either too sensitive (or not sensitive enough) to faults in the printer circuitry. Unfortunately, the use of integrated components in the reference circuitry of the fault detection logic makes it difficult to adequately adjust sensitivity by manipulating component parameters (such as gain and resistance values) in the comparator logic. Hence, there remains a need for fault check circuitry with improved ability to adjust sensitivity.

These and other problems with conventional fault check circuitry for ink jet printers are addressed by the present invention.

SUMMARY OF THE INVENTION

Briefly stated, one embodiment of the invention comprises a pen fault check circuit for an ink jet printer that includes a comparator comprising a pen signal input, and a switch array coupled to the pen signal input, wherein the switch array comprises a high voltage diode.

Another embodiment of the invention comprises a print head for an ink jet printer that includes a pen comprising an array of ink jet nozzles. A fault check circuit is coupled to the array of ink jet nozzles. The fault check circuit includes a switch array where each switch comprises a low voltage transistor and one or more high voltage diodes coupled in series with the low voltage transistor.

Still another embodiment of the invention comprises a method of checking for faults in a pen of an ink jet printer that includes generating a pen signal from a first constant current source and a pulse line resistance from a pulse line of an ink jet nozzle, generating a reference signal from a second constant current source and an external resistance from a external resistor, wherein the first current source and the second current source generate equal currents, and comparing the pen signal and the reference signal to determine if the ink jet nozzle is in a fault state.

Additional novel features shall be set forth in part in the description that follows, and in part will become apparent to those skilled in the art upon examination of the following specification or may be learned by the practice of the invention. The features and advantages of the invention may be realized and attained by means of the instrumentalities, combinations, and methods particularly pointed out in the appended claims.

DETAILED DESCRIPTION OF THE PREFERRED EMBODIMENTS

Figure 1:
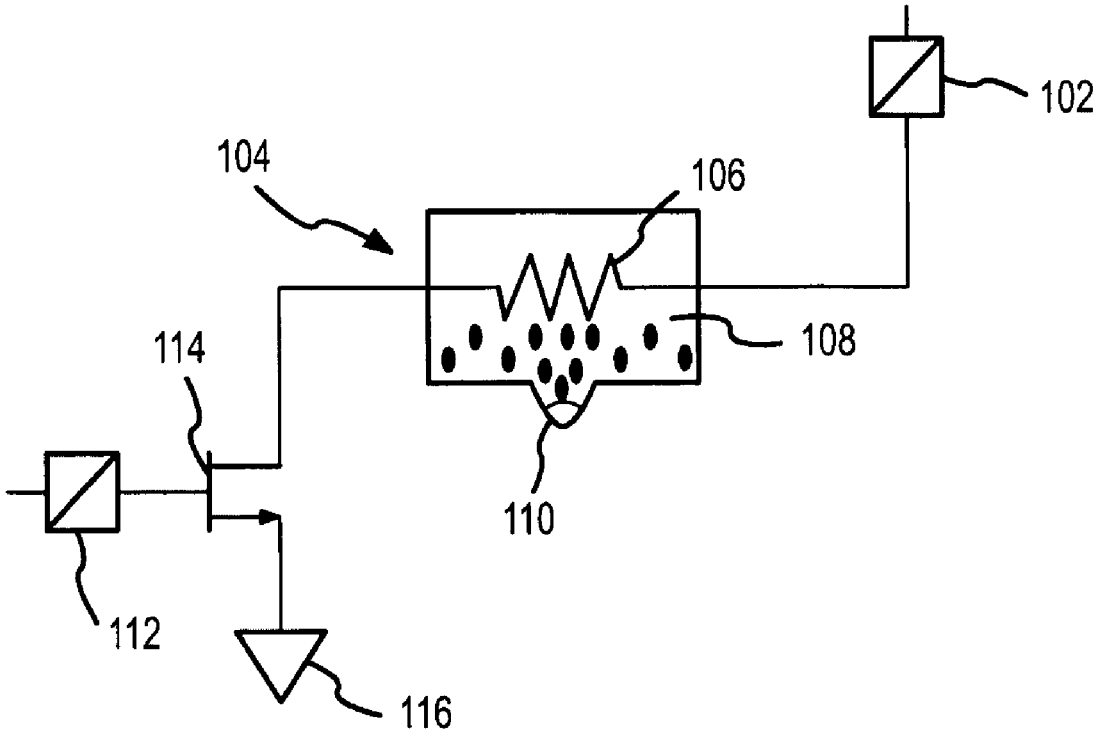
FIG. 1 shows a schematic diagram for an example of a nozzle component of an ink jet pen.

The present invention includes methods for checking faults in a pen of an ink jet printer and pen fault check circuits that may be used in ink jet printers. The pens being checked for faults may comprise one or more nozzles like, for example, nozzle 100 shown in FIG. 1.

Nozzle 100 includes a reservoir heater 104 that is coupled to a pulse node 102 by a pulse line, and is also coupled to a ground node 116 through a switch 114. Address node 112 opens and closes switch 114 such that when switch 114 is closed, current may flow from the pulse node 102, through reservoir heater 104, to ground node 116. Conversely, when switch 114 is open current from the pulse node does not flow through reservoir heater 104.

In operation, when a voltage is applied to pulse node 102 and switch 114 is open, current flows through heater resistor 106 inside the reservoir heater 104, quickly raising the temperature of resistor 106. As resistor 106 heats up, ink 108 inside reservoir heater 104 starts vaporizing, causing a bubble to form that pushes a droplet of ink 108 through nozzle head 110 and onto a print substrate (e.g., paper).

Figure 2:
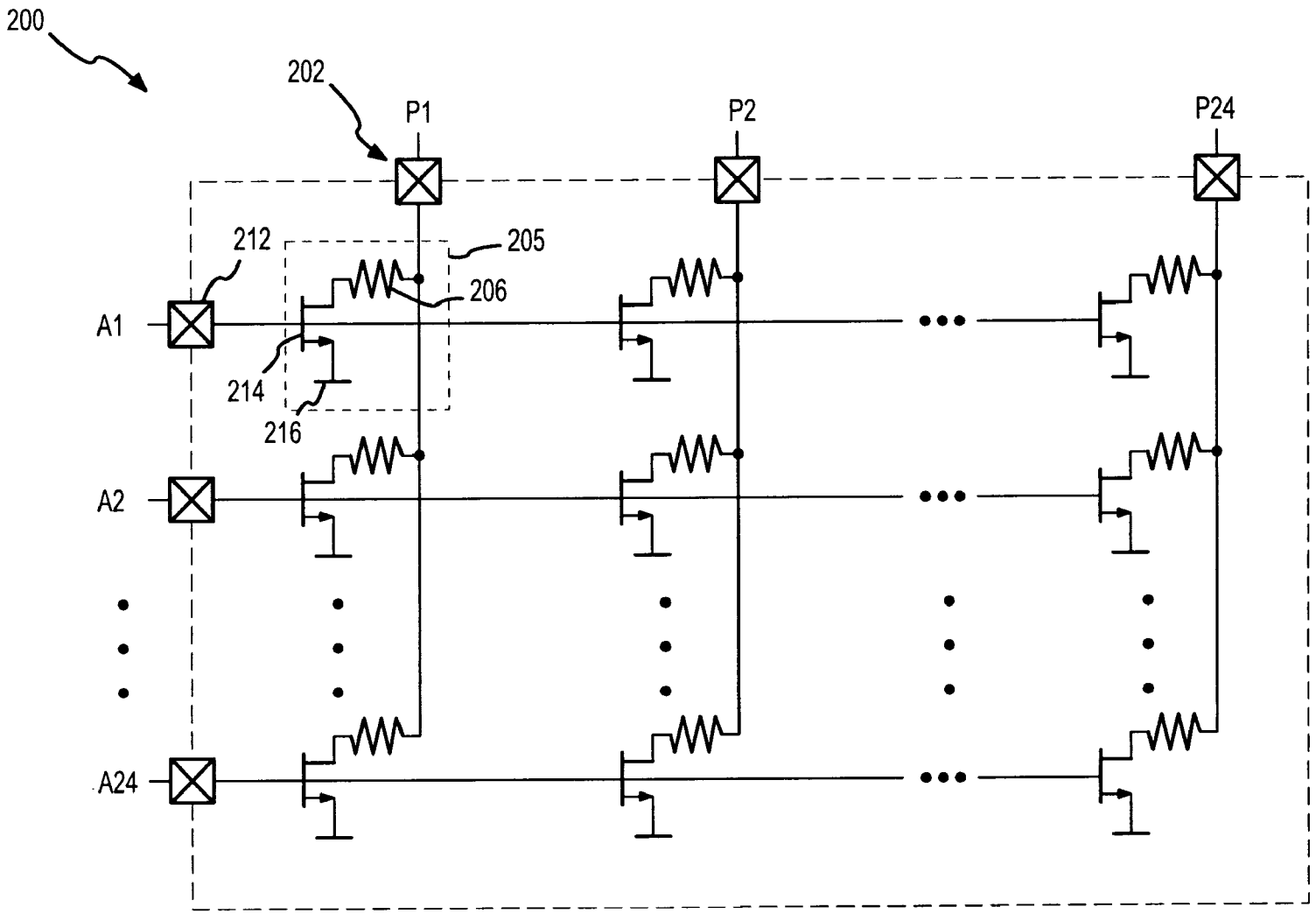
FIG. 2 shows a schematic diagram of an example of an array of ink jet nozzles that make up an ink jet pen.

An ink jet pen may comprise a plurality of nozzles like nozzle 100. FIG. 2 shows an example of a 24×24 nozzle array 200 for an ink jet pen. Individual nozzle units 205, are arranged into 24 rows and 24 columns, with each nozzle unit 205 coupled to a pulse node 202 and an address node 212. Each pulse node 202 is coupled to a P_Line that drives a high voltage onto all of the nozzle units 205 in a column of the array. Each address nodes 212 is coupled to an A_Line that activate a row of switches 214.

By way of comparison, the A_Line can be driven by signals at conventional logic levels (e.g., 2.7-5.0 volts) which are referred to herein as "low voltage". The P_Line is typically driven with voltages in the 10-24 volt range and are referred to herein as "high voltage". While the specific voltage levels in a particular application will vary, the term "high voltage" is intended to refer to voltages that are above logic level and so are generated by power supplies that are independent from the conventional integrated logic devices used to implement the pen fault check circuitry or other system logic.

In operation, individual nozzle units 205 are selected for firing by applying a high voltage to pulse node 202 and activating an address node 212 that intersect at the selected nozzle unit 205. When a nozzle unit 205 is selected for firing, switch 214 is closed, permitting current to flow from the activated pulse node 202, through heater resistor 206, to high voltage ground node 216. Similar to the operation of nozzle 100, current flowing through resistor 206 quickly heats the resistor and creates a bubble of vaporized ink (not shown) around resistor 206. The bubble forces an ink droplet through a nozzle head (not shown) onto a print substrate (e.g., paper).

It should be appreciated that the size and arrangement of the square 24×24 nozzle array 200 is but one of many contemplated by the present invention. The shape of nozzle array may include, without being limited to, square, rectangular, triangular, trapezoidal, and circular, among other shapes. Also, while nozzle array 200 has 576 individual nozzle units 205, nozzle arrays with larger and fewer numbers of nozzle units 205 are contemplated.

Figure 3:
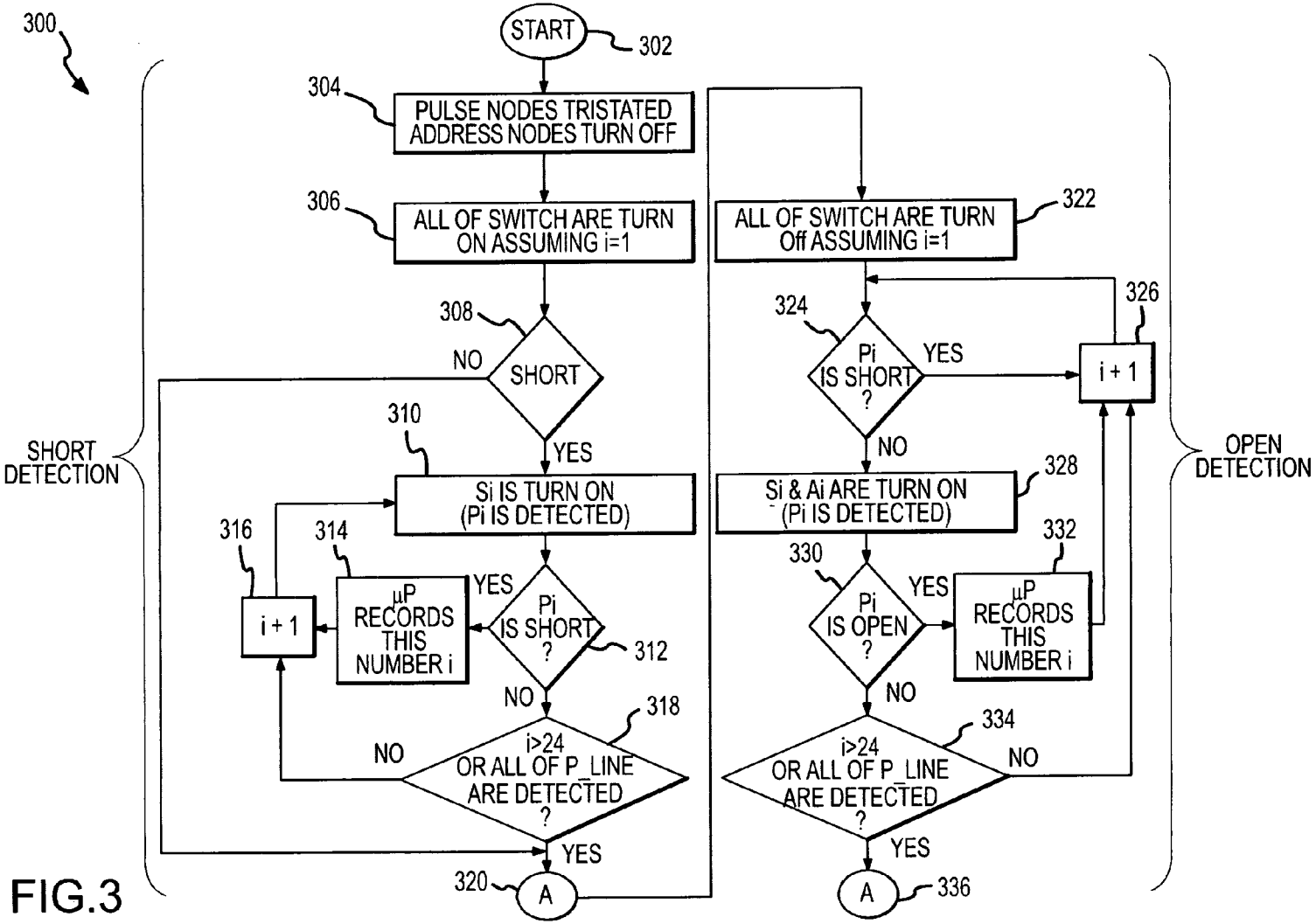
FIG. 3 shows a flowchart for an example of a method for checking for faults in an ink jet pen.

As noted above, pens in ink jet printers are prone to faults. These faults may include having an open circuit or short circuit somewhere in the pulse line that couples a pulse node to a heater resistor and/or the line coupling the heater resistor to an address node. The term "short circuit" refers to a condition in which excessive current leakage exists ranging from leakage that is in excess of a tolerable threshold up to and including a complete short circuit (i.e., zero resistance). The term "open circuit" refers to a condition in which excessive parasitic resistance exists ranging from resistance that is in excess of a tolerable threshold up to and including a complete open circuit (i.e., infinite resistance). An example of a method to check for these faults is shown in FIG. 3. For this example, a 24×24 nozzle array like the one shown in FIG. 2 is checked for short circuits and open circuits.

From start 302, the pulse nodes ($P_i$, where i=1 to 24) on the P_Line are tristated (i.e., placed in a high impedance state) and the address nodes are turned on. Switches 422 (shown in FIG. 4) are turned on to apply a test signal to all the pulse nodes ($P_{1-24}$) simultaneously at operation 306. This enables the entire array to be evaluated simultaneously to determine if a short circuit exists in 308. If no short is detected, then the short circuit detection phase ends and the open circuit detection phase begins at 320.

On the other hand, when a short circuit is detected at 308, it is preferable to identify a specific P_Line that produced the short circuit indication. In operation 310, while all P_Lines remain tristated, a single switch 422 is activated to apply the test signal to a single P_Line. If a short circuit is detected, for example by the flow of any current, this fact is recorded at operation 314 and the next pulse node (e.g., $P_{i+1}$) is selected at operation 316. After all pulse nodes ($P_1$ through $P_{24}$) are checked at operation 318, the short circuit detection phase ends and the open circuit detection phase begins at 320.

The open circuit detection phase starts by switching off all switches 422 at operation 322. Subsequently, each column of nozzle units is examined in turn to detect an open or high impedance. Before the individual pulse ($P_i$) and address ($A_i$) nodes are activated in operation 328, a check may be made in operation 324 to determine whether a short circuit was discovered for that P_Line during the short circuit detection phase. If a short was detected, the pulse node ($P_i$) is skipped 326 before being checked for an open circuit condition.

In operation 328, each P_Line ($P_i$) is sequentially coupled by a switch 422 to the test signal while an address line (A_Line) is used to activate a row of address nodes ($A_i$) . Hence, current at a level determined by the test signal magnitude, will be allowed to flow through a nozzle unit 205 at the intersection of the current $P_i/A_i$. If the current is less than a predetermined threshold, a high impedance or open condition exists in that P_Line as determined in 330.

If an open circuit is detected in an individual pulse node (Pi), this fact is recorded at 332, and the next pulse node ($P_{i+1}$) is checked for an open circuit in 326. After all pulse nodes (e.g., $P_{1\text{-}24}$ in the particular examples) are checked in operation 334, the open circuit detection phase ends at 336.

A significant feature of the present invention is that during the fault check protocol of FIG. 3, the test signal is a low voltage, preferably logic level signal. In contrast, prior pen fault detection mechanisms used a high voltage, greater than logic level, typically the same voltage used to operate the pen.

Figure 4:
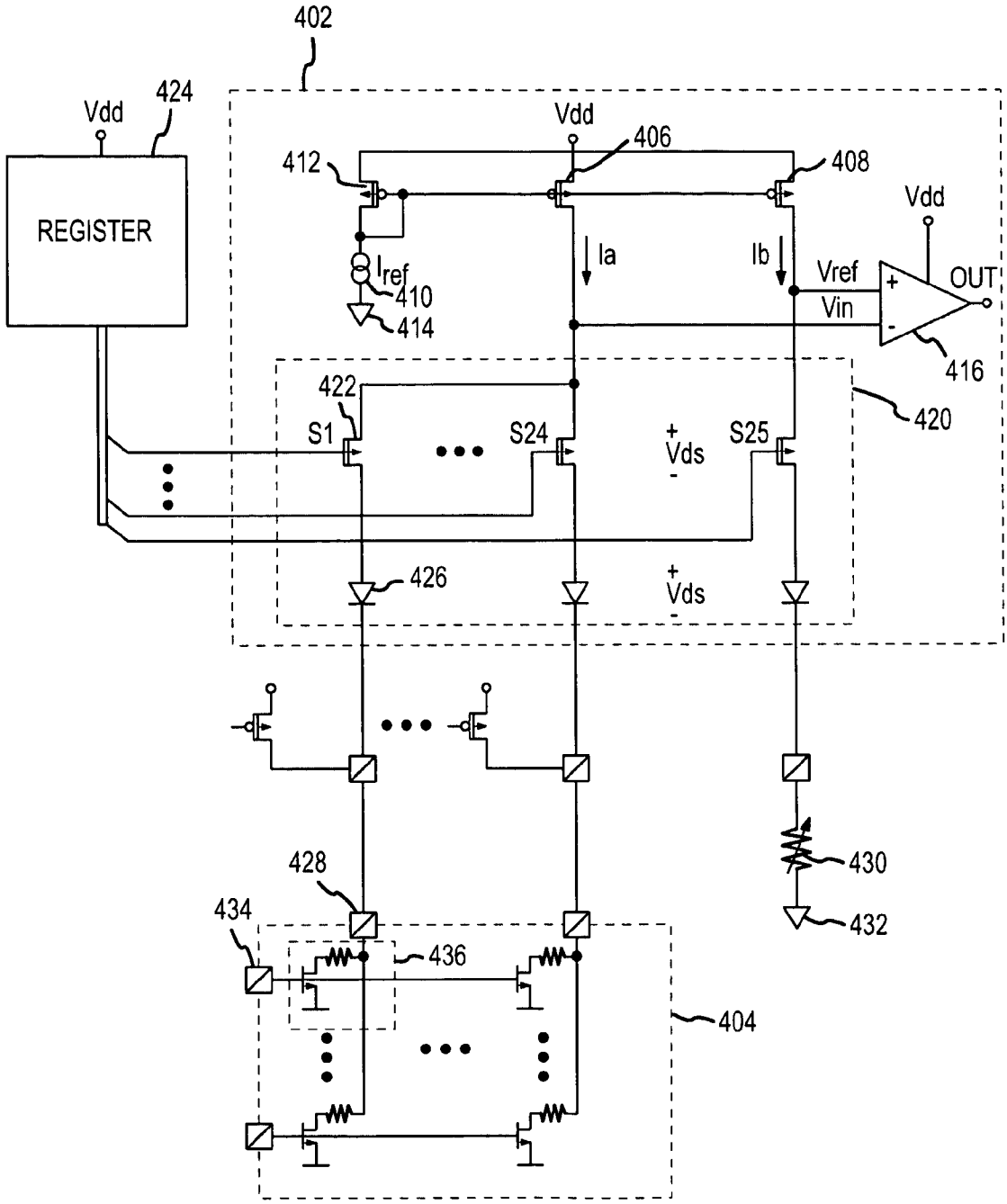
FIG. 4 shows a schematic diagram of a pen fault check circuit coupled to an ink jet pen according to an embodiment of the invention.

Methods for checking faults in a pen of an ink jet printer may be implemented by examples of pen fault check circuits according to the present invention. One example of a pen fault check circuit 402 according to the invention, which is coupled to a pen 404 comprising nozzle array, is shown in FIG. 4. In this example, the fault check circuit 402 includes a first switch 406 that implements first constant current source ($I_a$) and a second switch 408 that implements a second constant current source ($I_b$). The first switch 406 and second switch 408 are coupled in a current mirror fashion to ground node 414 through switch 412 such that $I_{ref}=I_a=I_b$.

The first and second constant current sources are coupled to switch array 420. The switch array 420 includes a number of switches 422 that may be individually opened and closed under control of values stored in register 424. The current $I_a$ from the first current source is coupled to a number "N" of the switches 422 where N is the number of P_Lines in the pen. One switch 422 is coupled to the current $I_b$ produced by the second current source.

Each switch 422 is coupled to a high-voltage diode 426 that protects the components of fault check circuit 402 from high voltage pulses generated by pulse nodes 428 firing nozzle units 436 of nozzle array 404 during normal operation. During normal operation (i.e., printing), switches 422 are turned off. However, because these are low voltage devices, a high operational voltage on a P_Line may adversely affect and/or damage the components of pen fault check circuit 402. Diodes 426, however, provide suitable protection from these operational voltages.

The first constant current source 406 and at least one P_line are coupled to a pen signal input of comparator 416 labeled $V_{in}$. The second constant current source 408 and a reference load 430 are coupled to a reference signal input on comparator 416 labeled $V_{ref}$. Reference load 430 may be implemented by, for example, an external variable impedance resistor that is connected to ground node 432. Comparator 416 also has a pen check output that indicates whether a fault state is present in a section of nozzle array 404.

Variable resistor 430 may be manually adjusted to change a detection threshold for detecting a fault in the pen. For example, increasing the resistance ($R_{ex}$) of external resistor 430 may cause the voltage ($V_{ref}$) to increase on the reference signal input of comparator 416. The increase in $V_{ref}$ may decrease the detection threshold sensitivity of fault check circuit 402.

In this example, the fault check circuit 402 is coupled to a 24×24 nozzle array 404 like the one shown in FIG. 2. The nozzle array 404 has twenty-four pulse nodes 428 and twenty-four address nodes that can act in concert to independently fire each of the nozzle units 436. Each of the twenty-four pulse nodes 428 is coupled to one of the high-voltage diodes 426 in switch array 420 through a (M) node.

The values of $V_{ref}$ and $V_{in}$ in FIG. 4 can be determined from the equations:

$$V_{ref}=I_b\times R_{ex}+V_d+V_{ds}$$

$$V_{in}=I_a\times R_{eq}+V_d+V_{ds}$$

where $I_b$ and $I_a$ represent the current from the first and second constant current sources, $V_d$ represents the forward voltage across the high-voltage diodes 426, $V_{ds}$ represents the on-voltage drop across the drain-source terminals of the switch 422, $R_{ex}$ represents the resistance of external resistor 430, and $R_{eq}$ represents the equivalent resistance pen circuit at pulse node.

Although $I_a$ and $I_b$ may be different, in most cases they are equal to each other. Accordingly, when $V_{ref}=V_{in}$, then $R_{ex}=R_{eq}$. A threshold resistance ($R_{th}$) is defined to be a nominal resistance value at which the pen circuit 404 would be considered neither a short circuit nor an open circuit. In the example, $R_{th}=R_{ex}$. Under these circumstances, the threshold resistance ($R_{th}$) is precisely known and controlled by external resistor 430. Thus, $R_{th}$ is insensitive to fluctuations in the power supply, process and temperature, and can be readily adjusted by adjusting external resistor 430. In contrast, circuit analysis of prior pen fault test mechanisms reveals an analog to $R_{th}$ that is sensitive to power supply, process and temperature variations and does not provide a ready method to compensate for these variations.

As compared to prior pen fault check circuits, important features in the example of FIG. 4 include the use of similar constant current sources to drive both the test signal (i.e., $I_a$) and the reference signal (i.e., $I_b$) at levels determined by a common current reference $I_{ref}$. Another feature is the use of an external impedance 430 as a reference impedance. This enables the fault check circuit to be adjusted to match a particular pen driver circuit and allows control over the sensitivity. Moreover, by coupling the external impedance 430 using a switch 422 and diode 426, variations associated with these components will be cancelled out.

Figure 5:
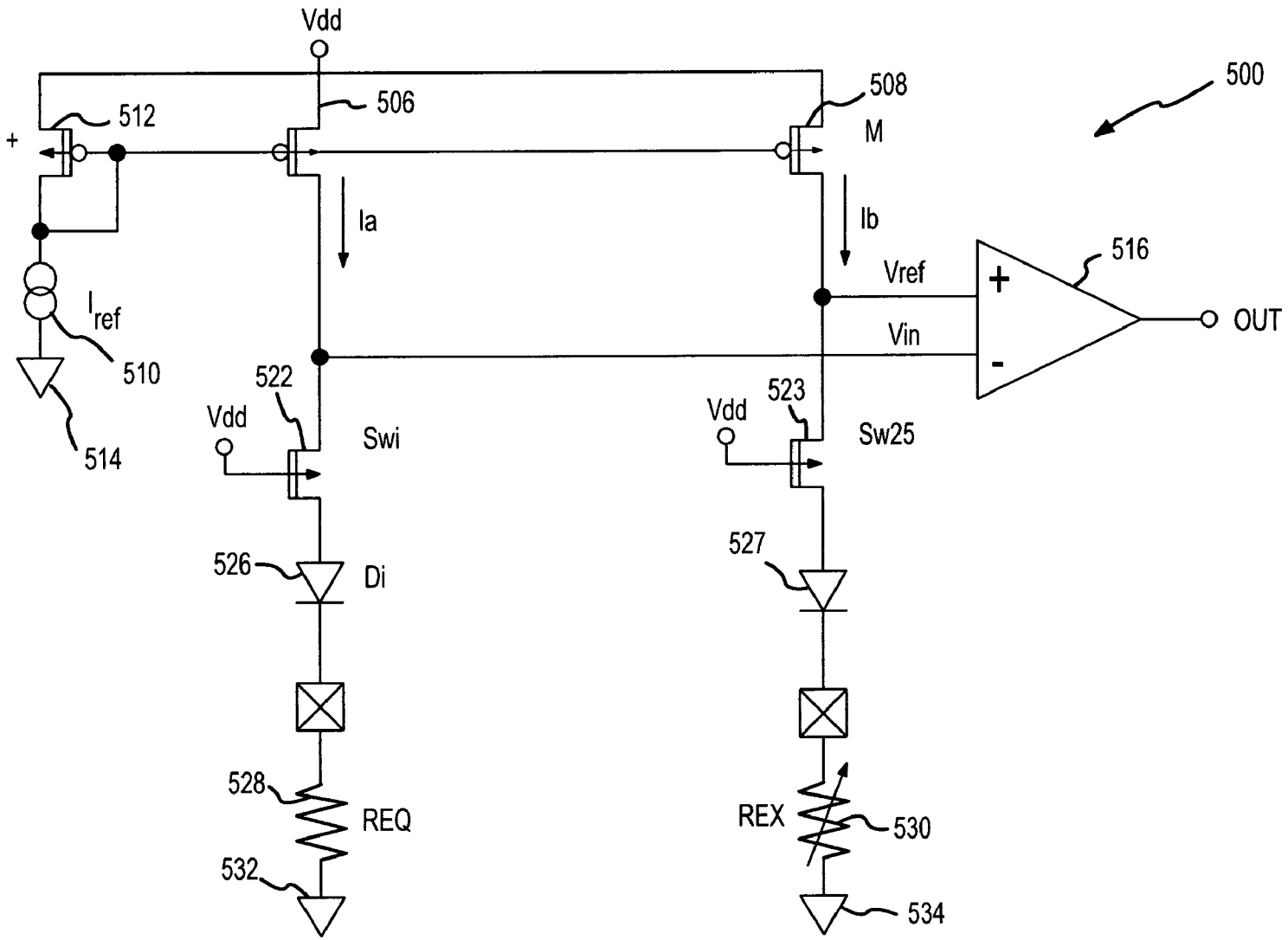
FIG. 5 shows a schematic diagram of a simulated pen fault check circuit according to an embodiment of the invention.

Simulations of another example of a pen fault check circuit were conducted to demonstrate that the reference signal ($V_{ref}$) and the pen signal ($V_{in}$) respond in the same way to changes in power supply voltage and temperature, and are therefore self-compensating. FIG. 5 shows a schematic of a pen fault check circuit 500 used in the simulations. The circuit 500 includes a first switch 506 for a first constant current source $I_a$ and a second switch 508 for a second constant current source $I_b$. The first switch 506 and second switch 508 are coupled in a current mirror arrangement to switch 512 to current reference 510 and ground node 514.

The first constant current source generates a first current ($I_a$) that is coupled to a pen signal input of comparator 516. The first constant current source is coupled through switch 522 and diode 526 to resistor REQ 528 that simulates the pen circuit equivalent resistance ($R_{eq}$) . Resistor 528 is coupled to ground node 532.

Another switch 523, which is preferably of similar construction to switch 522, is coupled to a group of elements that generate the reference signal voltage on the reference signal input of comparator 516. The second constant current source is coupled through switch 523 and diode 527 to resistor REX 530 that simulates the threshold resistance ($R_{th}$). Resistor 530 is coupled to ground node 534.

Figure 6:
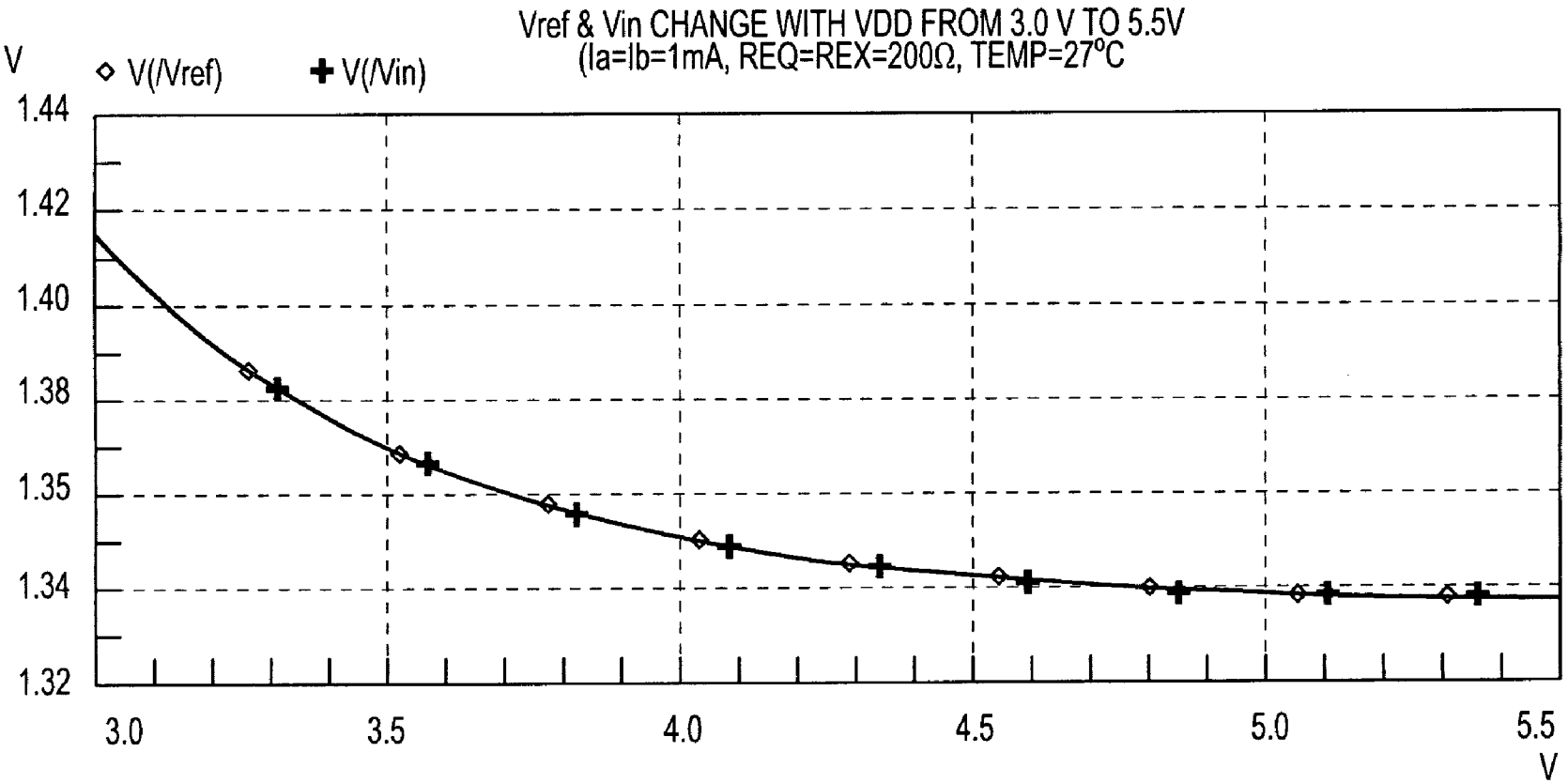
FIG. 6 shows a graph of $V_{ref}$ and $V_{in}$ as a function of $V_{cc}$ in a simulated pen fault check circuit according to an embodiment of the invention.

FIG. 6 shows a graph of reference signal voltage ($V_{ref}$) and pen signal voltage ($V_{in}$) as a function of the power supply voltage ($V_{dd}$) recorded during a simulation of a pen fault check circuit 500. In this simulation $I_a$ and $I_b$ were both set to 1 milliamp, $R_{eq}$ and $R_{ex}$ where both set to 200 ohms, and the temperature was kept constant at 27 degrees Celsius. As the waveform demonstrates, variations in $V_{ref}$ and $V_{in}$ substantially track each other to each other across a range of $V_{dd}$ from 3.0 Volts to 5.5 Volts. As a result, the pen fault check mechanism in accordance with the present invention is highly insensitive to variations in $V_{dd}$.

Figure 7:
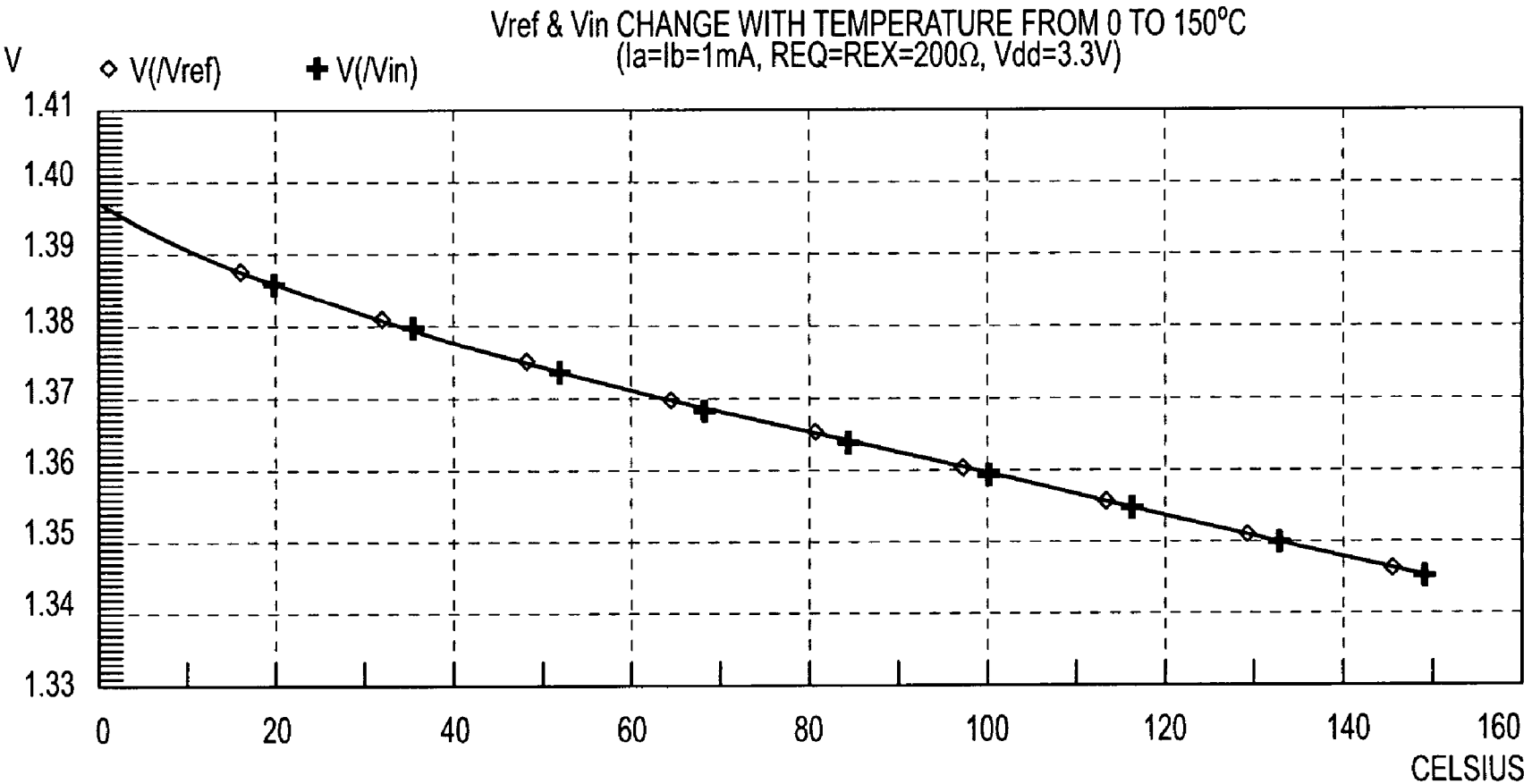
FIG. 7 shows a graph of $V_{ref}$ and $V_{in}$ as a function of temperature in a simulated pen fault check circuit according to an embodiment of the invention.

FIG. 7 shows a graph of reference signal voltage ($V_{ref}$) and pen signal voltage ($V_{in}$) as a function of temperature recorded during a simulation of a pen fault check circuit 500. In this simulation $I_a$ and $I_b$ were both set to 1 milliamp, $R_{eq}$ and $R_{ex}$ where both set to 200 ohms, and the power supply voltage was kept constant at 3.3 Volts. As the waveform demonstrates, $V_{ref}$ and $V_{in}$ stayed equal to each other across a range of temperatures from 0 to 150 degrees Celsius. As a result, the pen fault check mechanism in accordance with the present invention is highly insensitive to variations in temperature.

Figure 8:
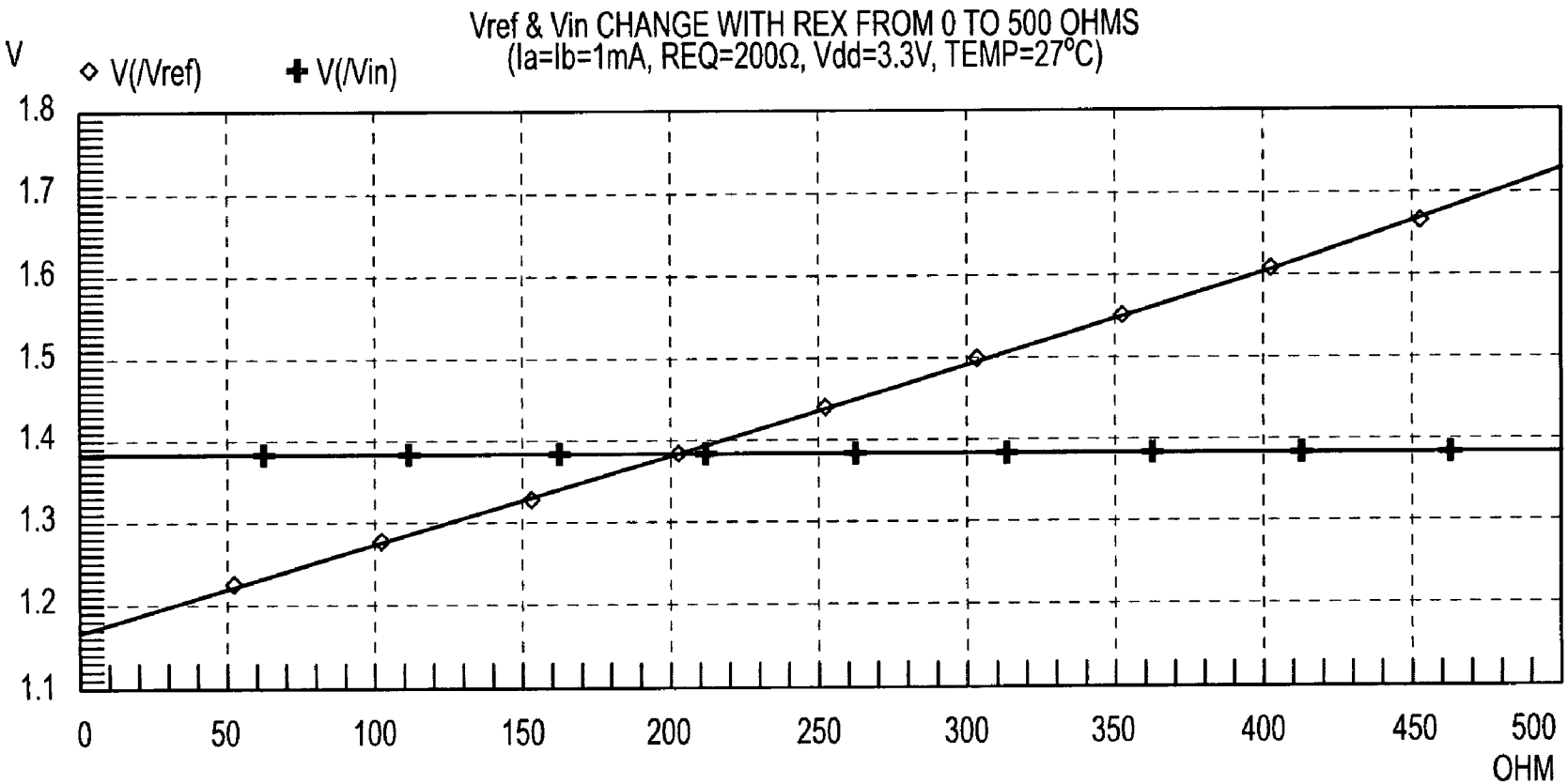
FIG. 8 shows a graph of $V_{ref}$ and $V_{in}$ as a function of the resistance of $R_{ex}$ in a simulated pen fault check circuit according to an embodiment of the invention.

FIG. 8 shows a graph of reference signal voltage ($V_{ref}$) and pen signal voltage ($V_{in}$) as function of the resistance ($R_{ex}$) of external resistor 530 recorded during a simulation of a pen fault check circuit 500. In this simulation $I_a$ and $I_b$ were both set to 1 milliamp, $R_{eq}$ was set to 200 ohms, the power supply voltage was 3.3 Volts, and the temperature was kept constant at 27 degrees Celsius. As the waveform shows, changing $R_{ex}$ over a range of 0 to 500 ohms has no effect on the pen signal voltage $V_{in}$ and increases the reference signal voltage $V_{ref}$ in a linear manner. As a result, the pen fault check mechanism in accordance with the present invention is highly sensitive and therefore readily adjustable by varying the value of an external impedance.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

I claim:

1. A pen fault check circuit for an ink jet printer, comprising:

a comparator comprising a pen signal input and a reference signal input;

a switch array coupled to the pen signal input, wherein the switch array comprises a high voltage diode;

a first constant current source coupled to the pen signal input and to a plurality of ink jet nozzle switches in the switch array; and a second constant current source coupled to the reference signal input and to a single reference switch in the switch array, wherein the first and second constant current sources have substantially equal current outputs, the high voltage diode of the switch array is coupled to a pulse node of an ink jet nozzle that is one of a plurality of ink jet nozzles in an ink jet nozzle array, and the switch array is coupled to a register that selects one of the plurality of ink jet nozzles in the ink jet nozzle array for a fault check.

2. The pen fault check circuit of claim 1, wherein the comparator comprises a pen check output.

3. The pen fault check circuit of claim 1, wherein the second constant current source is coupled to an external resistor that sets a detection threshold for the fault check circuit.

4. The pen fault check circuit of claim 3, wherein the external resistor is manually adjusted by an operator of the ink jet printer.

5. The pen fault check circuit of claim 1, wherein the ink jet nozzle array comprises a pen.

6. A pen for an ink jet printer, comprising:

an array of ink jet nozzles, wherein the array comprises a plurality of ink jet nozzles; and a fault check circuit coupled to the array of ink jet nozzles, wherein the fault check circuit includes a switch array comprising one or more high voltage diodes and a comparator having a pen signal input and a reference signal input, wherein the fault check circuit is coupled to a first and a second constant current source, wherein the first constant current source is coupled to the pen signal input and to a plurality of ink jet nozzle switches in the switch array and the second constant current source is coupled to the reference signal input and to a single reference switch in the switch array, and wherein the first and the second constant current sources have equal current outputs and wherein at least one of the high voltage diodes of the switch array is coupled to a pulse node of an ink jet nozzle that is one of a plurality of ink jet nozzles in an ink jet nozzle array, and the switch array is coupled to a register that selects one of the plurality of ink jet nozzles in the ink jet nozzle array for a fault check.

7. The pen of claim 6, wherein the second constant current source is coupled to an external resistor that sets a detection threshold for the fault check circuit.

8. A method of checking for faults in a pen of an ink jet printer comprising:

generating a pen signal from a first constant current source and a pulse line resistance from a pulse line of an ink jet nozzle;

generating a reference signal from a second constant current source and an external resistance from an external resistor, wherein the first current source and the second current source generate equal currents; and comparing the pen signal and the reference signal to determine if the ink jet nozzle is in a fault state, wherein the first constant current source is coupled to a plurality of ink jet nozzle switches in a switch array comprising a high voltage diode to prevent a pulse voltage from the pulse line of the ink jet nozzle from damaging the switch array, the high voltage diode of the switch array being coupled to a pulse node of an ink jet nozzle that is one of a plurality of ink jet nozzles in an ink jet nozzle array, and the switch array being coupled to a register that selects one of the plurality of ink jet nozzles in the ink jet nozzle array for a fault check and the second constant current source is coupled to a single reference switch in the switch array.

9. The method of claim 8, wherein the pen signal and the reference signal have a same reaction to a change in temperature.

10. The method of claim 8, wherein the external resistor controls a threshold detection limit to detect the fault state.

11. The method of claim 8, wherein the fault state is an open state or a shorted state.

12. A pen fault check circuit for an ink jet printer, comprising:

a comparator comprising a pen signal input; and a switch array coupled to the pen signal input, wherein the switch array comprises a high voltage diode, wherein the high voltage diode of the switch array is coupled to a pulse node of an ink jet nozzle that is one of a plurality of ink jet nozzles in an ink jet nozzle array, and wherein the switch array is coupled to a register that selects one of the plurality of ink jet nozzles in the ink jet nozzle array for a fault check, wherein the comparator comprises a reference signal input and a pen check output, and wherein the circuit comprises a first and a second constant current source, wherein the first constant current source is coupled to the pen signal input and to a plurality of ink jet nozzle switches in the switch array and the second constant current source is coupled to the reference signal input and to a single reference switch in the switch array.

13. The pen fault check circuit of claim 12, wherein the first and second constant current sources have substantially equal current outputs established by a current reference.

14. The pen fault check circuit of claim 12, wherein the second constant current source is coupled to an external resistor that sets a detection threshold for the fault check circuit.

15. The pen fault check circuit of claim 14, wherein the external resistor is manually adjusted by an operator of the ink jet printer.

16. The pen fault check circuit of claim 14, wherein the ink jet nozzle array comprises a pen.

17. A pen fault check circuit for an ink jet printer, comprising:

a comparator comprising a pen signal input, a reference signal input, and an output;

a switch array coupled to the pen signal input and the reference signal input, wherein the switch array comprises a plurality of high voltage diodes;

a first constant current source coupled to the pen signal input and to a plurality of ink jet nozzle switches in the switch array;

a second constant current source coupled to the reference signal input and to a single reference switch in the switch array;

a nozzle array coupled to the switch array; and a register coupled to the switch array for selecting one of a plurality of ink jet nozzles in the nozzle array for a fault check.

18. The pen fault check circuit of claim 17 further comprising a current mirror having an input for receiving a reference current, a first output for providing the first constant current source, and a second output for providing the second constant current source.

19. The pen fault check circuit of claim 18 wherein the current mirror comprises a P-channel current mirror.

20. The pen fault check circuit of claim 17 wherein the switch array further comprises an input for coupling to an external resistor.

21. The pen fault check circuit of claim 20 wherein the external resistor comprises an adjustable resistor.

22. The pen fault check circuit of claim 17 wherein the switch array comprises an array of N-channel transistors.

23. The pen fault check circuit of claim 22 wherein a gate of each of the N-channel transistors is coupled to the register.

24. The pen fault check circuit of claim 22 wherein each of the high voltage diodes are respectively coupled to a source/drain of said N-channel transistors.

25. The pen fault check circuit of claim 17, wherein the nozzle array comprises a pen.

* * * * *

UNITED STATES PATENT AND TRADEMARK OFFICE

CERTIFICATE OF CORRECTION

PATENT NO. : 7,614,717 B2
APPLICATION NO. : 11/103695
DATED : November 10, 2009
INVENTOR(S) : Chunxing Deng It is certified that error appears in the above-identified patent and that said Letters Patent is hereby corrected as shown below:

Column 9, line 27, "claim 14" should be --claim 12--

Signed and Sealed this

First Day of June, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,614,717 B2
APPLICATION NO. : 11/103695
DATED : November 10, 2009
INVENTOR(S) : Chunxing Deng It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 457 days.

Signed and Sealed this

Nineteenth Day of October, 2010

David J. Kappos

David J. Kappos
*Director of the United States Patent and Trademark Office*